US005173061A

United States Patent [19]

Comerci et al.

[11] Patent Number: 5,173,061

[45] Date of Patent: Dec. 22, 1992

[54] TELECOMMUNICATIONS OUTLET

[75] Inventors: Joseph D. Comerci, Elmhurst; Mark M. Data, Bolingbrook; Robert DeRoss, Naperville, all of Ill.

[73] Assignee: Molex Incorporated, Lisle, Ill.

[21] Appl. No.: 836,041

[22] Filed: Feb. 12, 1992

[51] Int. Cl.[5] ..... H01K 13/74

[52] U.S. Cl. ..... 439/536; 439/553

[58] Field of Search ..... 439/535, 536, 538, 76, 439/553, 554

[56] References Cited

U.S. PATENT DOCUMENTS

| | | | |
|---|---|---|---|
| 4,261,633 | 4/1981 | Abernethy | 439/406 |
| 4,477,141 | 10/1984 | Hardesty | 439/536 |
| 4,494,815 | 1/1985 | Brzostek et al. | 439/536 |
| 4,725,249 | 2/1988 | Blackwood et al. | 439/535 |
| 4,756,695 | 7/1988 | Lane et al. | 439/535 |
| 4,894,024 | 1/1990 | Debortoli et al. | 439/535 |
| 4,909,757 | 3/1990 | Reed | 439/532 |
| 5,013,260 | 5/1991 | Caveney et al. | 439/535 |

FOREIGN PATENT DOCUMENTS

| | | | |
|---|---|---|---|
| 1203590 | 4/1986 | Canada | 339/48 |

*Primary Examiner*—Gary F. Paumen

*Attorney, Agent, or Firm*—Stephen Z. Weiss

[57] ABSTRACT

A telecommunications outlet includes an outlet housing and a telecommunications module assembly. The outlet housing includes an opening into which a complementary mating telecommunications plug can be inserted from the front of the housing. The telecommunications module assembly includes a telecommunications module mounted on a printed circuit board. Guide tracks project rearwardly from the outlet housing for slidably engaging opposite edges of the printed circuit board for guiding the module assembly into an operable position with the telecommunications module aligned with the opening for mating with the telecommunications plug. A latch arm projects rearwardly of the housing for holding the module assembly in its operable position. An electrical connector is mounted on the printed circuit board rearwardly of the telecommunications module for easy access thereto.

16 Claims, 2 Drawing Sheets

TELECOMMUNICATIONS OUTLET

FIELD OF THE INVENTION

This invention generally relates to the art of electrical connectors, and, particularly, to a telecommunications outlet for mounting in a wall or the like.

BACKGROUND OF THE INVENTION

It is generally known to provide telecommunications outlets for mounting in a wall panel to locate a telecommunications module, such as a modular jack, behind an opening in the wall panel. The telecommunications module provides a terminal for a user's internal wiring for mating with a complementary telecommunications plug inserted through the wall opening into mating interconnection with the module. The plug is coupled to telecommunications equipment such as telephones, data processing terminals and the like.

For instance, it has become generally common to use such telecommunications wall outlets in ordinary households, with an outlet carrying a modular jack and another connector upon a support. The modular jack may be prewired in a production environment to the other connector. This telecommunications module assembly then is mounted to the wall outlet on site, and the other connector is coupled to the user's internal wiring, with the outlet mounted behind the opening in the wall panel.

Heretofore, problems have been encountered in using such telecommunications outlets because they do not provide for easy installation and, after installation, do not provide easy access to the other connector for carrying-out the internal wiring schemes. In addition, the support for the telecommunications module, or modular jack, and the other connector may be a small printed circuit board. There must be provided some form of delicate mounting means for the printed circuit board onto the wall outlet and which provides for easy assembly thereto. Once assembled to or mounted on the outlet, it is highly desirable to provide some form of latching or locking means for holding the telecommunications module/connector assembly in operable position on the wall outlet.

This invention is directed to providing a telecommunications outlet and module assembly which solves the above problems and satisfies the stated needs.

SUMMARY OF THE INVENTION

An object, therefore, of the invention is to provide a new and improved telecommunications outlet for mounting a telecommunications module assembly on a wall panel or the like.

The invention is disclosed herein in a telecommunications outlet which includes an outlet housing and a telecommunications module assembly. The outlet housing includes an opening into which a complementary mating telecommunications plug can be inserted from the front of the housing. The telecommunications module assembly includes a telecommunications module mounted on a support, such as a printed circuit board.

The invention contemplates the provision of complementary interengaging guide means between the rear of the housing and an edge of the printed circuit board for guiding the module assembly into an operable position with the telecommunications module aligned with the housing opening for mating with the telecommunications plug therethrough. Complementary interengaging latch means are provided between the housing and the telecommunications module for holding the module assembly in the operable position.

In the exemplary embodiment of the invention, the housing includes a faceplate with the opening therethrough. The guide means are provided in the form of opposing slot-like tracks projecting generally perpendicularly away from the rear of the faceplate for engaging opposite side edges of the printed circuit board. The latch means include a flexible cantilevered locking arm projecting generally perpendicularly away from the rear of the faceplate for locking behind a portion of the telecommunications module.

The invention also contemplates that the telecommunications module assembly includes another electrical connector mounted on the printed circuit board rearwardly of the telecommunications module for easy access thereto, to facilitate easy internal wiring in on site applications.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
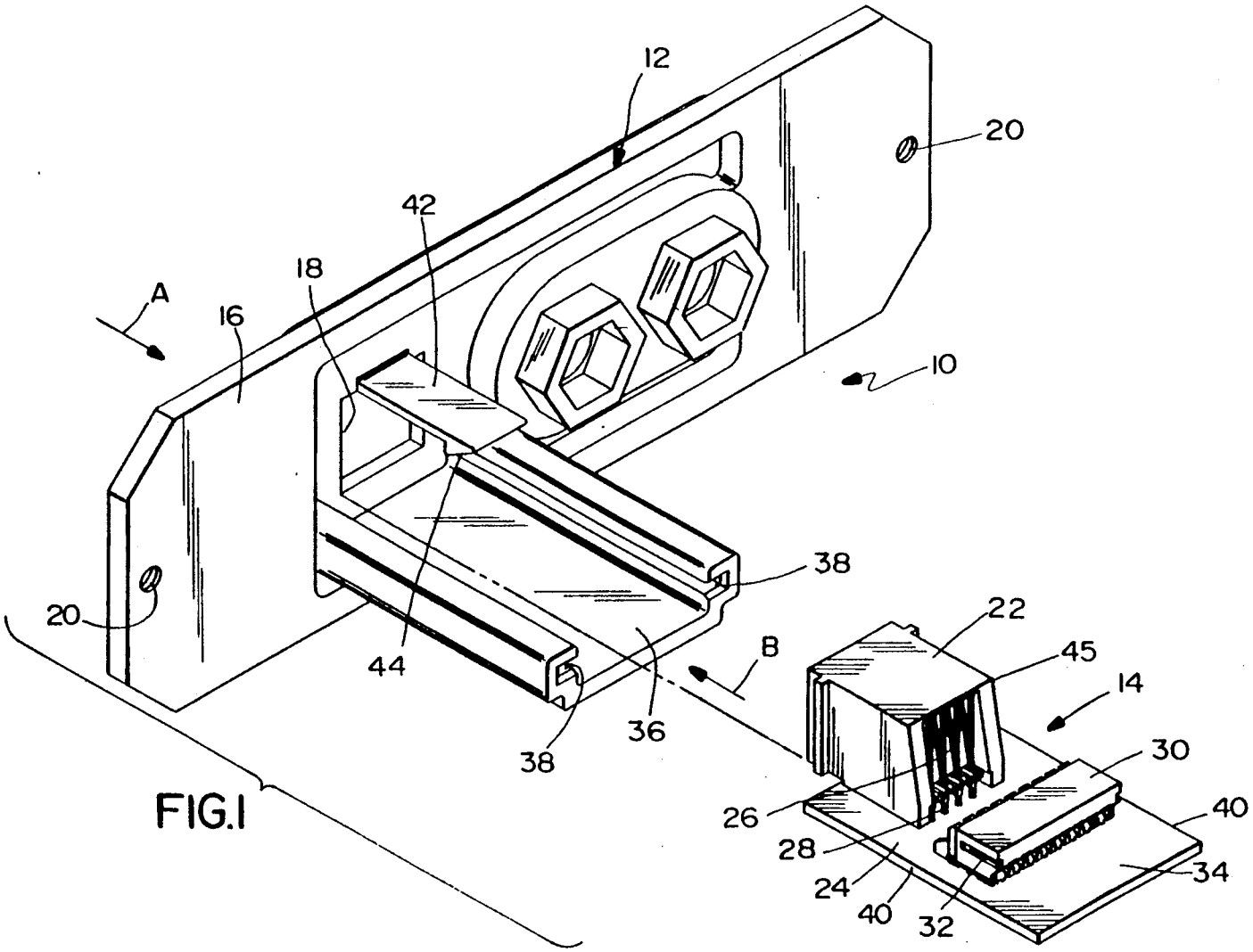
FIG. 1 is an exploded perspective view of the outlet housing and the telecommunications module assembly which comprise the telecommunications outlet of the invention.

Referring to the drawings in greater detail, the invention is disclosed in a telecommunications outlet, generally designated 10, which includes an outlet housing, generally designated 12, and a telecommunications module assembly, generally designated 14.

Outlet housing 12 includes a faceplate 16 having an opening 18 therethrough and into which a complementary mating telecommunications plug (not shown) can be inserted in the direction of arrow "A" from the front of the housing. Faceplate 16 is appropriately mountable over an aperture in a wall panel or the like by appropriate fastening means, such as screws insertable through holes 20 in the faceplate.

Telecommunications module assembly 14 includes a telecommunications module which is shown in the form of a substantially conventional modular jack 22 mounted on a printed circuit board 24. The modular jack is a right-angled jack having terminals 26 with solder tails 28 projecting through holes in printed circuit board 24 for soldering to circuit traces on the board or plated within the holes. Another or second electrical connector 30 is similarly mounted onto the top of printed circuit board 24 with appropriate terminals connected to the circuit traces on the board to thereby electrically couple the terminals of the modular jack to the terminals of the other connector. The other connector may be a wire trap connector having receptacle means 32 for receiving wires into electrical connection with the connector terminals. Wire designations 34 may be silk screened onto the top of printed circuit board 24 in alignment with respective ones of the wire trap terminals. For purposes described hereinafter, it should be noted that second connector 30 is mounted on printed circuit board 24 rearwardly of modular jack 22.

The invention contemplates that complementary interengaging guide means be provided between the rear of outlet housing 12 and telecommunications module assembly 14 to mount the assembly projecting from the rear of faceplate 16. More particularly, a plate-like guide means 36 projects generally perpendicularly away from the rear of faceplate 16. The guide means include slot-like tracks 38 along opposite side edges thereof for receiving side edges 40 of printed circuit board 24. Therefore, the board projects generally perpendicularly away from the rear of faceplate 16 of outlet housing 12. Telecommunications module assembly 14 can be easily mounted to the rear of the outlet housing by sliding the assembly in the direction of arrow "B" (FIG. 1) into guide means 36, as side edges 40 of printed circuit board 24 slide into tracks or slots 38.

Figure 2:
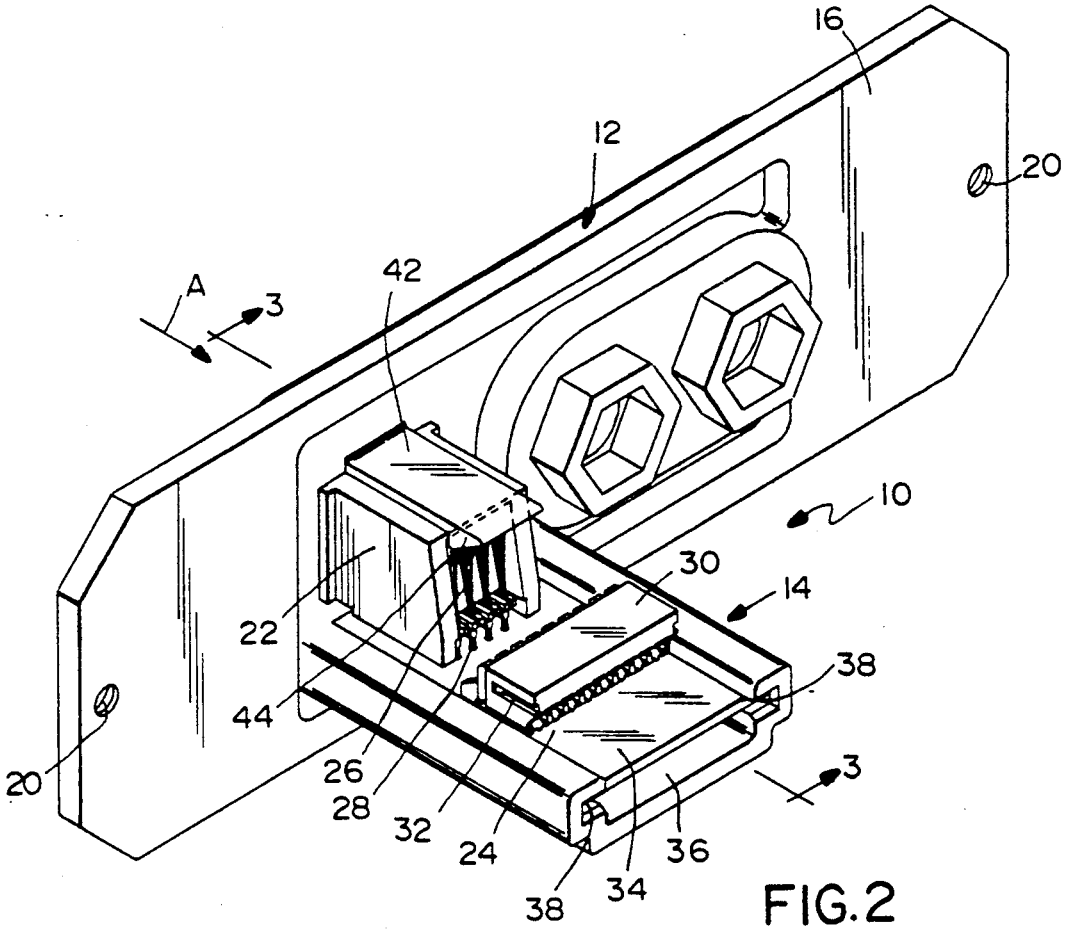
FIG. 2 is a perspective view similar to that of FIG. 1, with the telecommunications module assembly mounted to the outlet housing.
Figure 3:
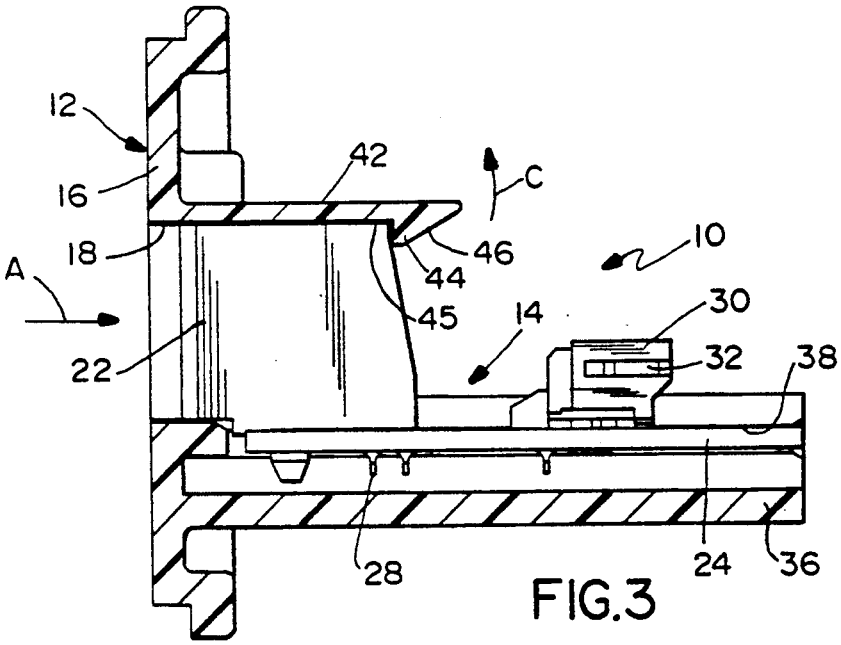
FIG. 3 is a vertical section, on an enlarged scale, taken generally along line 3—3 of FIG. 1.

When telecommunications module assembly 14 is fully engaged within guide means 36 and tracks 38 to the position shown in FIGS. 2 and 3, complementary interengaging latch means are provided between outlet housing 12 and the module assembly for holding the assembly in its operable position. More particularly, a cantilevered locking arm 42 projects generally perpendicularly away from the rear of faceplate 16, immediately above opening 18. The cantilevered locking arm includes a hook portion 44 on the distal end thereof for snapping behind the upper rear corner 45 of modular jack 22 as seen in FIGS. 2 and 3, for holding the entire module assembly 14 in its operable position as shown, with modular jack 22 aligned with and behind opening 18 in faceplate 16. Therefore, the complementary mating telecommunications plug can be inserted through opening 18 in the direction of arrow "A", as best seen in FIG. 3, for mating the plug with the modular jack. Outlet housing 12 preferably is unitarily molded of dielectric material such as plastic or the like and cantilevered arm 42 is molded integrally therewith, whereby the locking arm can pivot upwardly in the direction of arrow "C" (FIG. 3) as the front of modular jack 22 engages a camming surface 46 rearwardly of hook portion 44 of the cantilevered locking arm. When the module assembly is fully seated in its operable position, cantilevered locking arm 42 will snap completely over modular jack 22, with hook portion 44 locking behind the top rear corner of the jack.

As stated above, the second or wire-trap connector 30 is mounted on printed circuit board 24 rearwardly of modular jack 22 as best seen in FIG. 3. By mounting the second connector rearwardly of the telecommunications module, it can be seen that the receptacle means 32 of the second connector is exposed rearwardly of the entire telecommunications module assembly for very easy access to insert wires or other terminals into the second connector and thereby facilitate easy wiring of the telecommunications system to a user's internal wiring system.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a telecommunications outlet which includes an outlet housing and a telecommunications module assembly, the outlet housing including an opening into which a complementary mating telecommunications plug can be inserted from the front of the housing, and the telecommunications module assembly including a telecommunications module mounted on a printed circuit board, wherein the improvement comprises complementary interengaging guide means on the rear of the housing and an edge of the printed circuit board for guiding the module assembly into an operable position with the telecommunications module aligned with said opening for mating with the telecommunications plug therethrough, and complementary interengaging latch means between the housing and the telecommunications module for holding the module assembly in said operable position, wherein said latch means include a flexible cantilevered locking arm for engaging and locking behind a portion of the telecommunications module.

2. In a telecommunications outlet as set forth in claim 1, wherein said outlet housing includes a faceplate with said opening therethrough.

3. In a telecommunications outlet as set forth in claim 2, wherein said guide means project generally perpendicularly away from the rear of the faceplate.

4. In a telecommunication outlet as set forth in claim 3, wherein said guide means comprise opposing track means for engaging opposite side edges of the printed circuit board.

5. In a telecommunications outlet as set forth in claim 4, wherein said track means comprise slots for embracing the opposite side edges of the printed circuit board.

6. In a telecommunications outlet as set forth in claim 2, wherein said latch means include a flexible cantilevered locking arm projecting generally perpendicularly away from the rear of the faceplate for locking behind a portion of the telecommunications module.

7. In a telecommunications outlet as set forth in claim 6, wherein said guide means project generally perpendicularly away from the rear of the faceplate.

8. In a telecommunication outlet as set forth in claim 7, wherein said guide means comprise opposing track means for engaging opposite side edges of the printed circuit board.

9. In a telecommunication outlet as set forth in claim 1, wherein said guide means comprise opposing track means for engaging opposite side edges of the printed circuit board.

10. In a telecommunications outlet as set forth in claim 1, wherein said telecommunications module assembly includes an electrical connector mounted on the printed circuit board rearwardly of the telecommunications module for easy access thereto.

11. In a telecommunications outlet which includes an outlet housing and a telecommunications module assembly, the outlet housing including an opening into which a complementary mating telecommunications plug can be inserted from the front of the housing, the telecommunications module assembly including a telecommunications module mounted on a generally planar support, wherein the improvement comprises complementary interengaging guide means on the rear of the housing and an edge of the planar support for guiding the module assembly into an operable position with the telecommunications module aligned with said opening for mating with the telecommunications plug therethrough, and complementary interengaging latch means between the housing and the telecommunications module for holding the module assembly in said operable position, wherein said latch means include a flexible cantilevered locking arm projecting generally perpendicularly away from the rear of the outlet housing for engaging and locking behind a portion of the telecommunications module.

12. In a telecommunications outlet as set forth in claim 1, wherein said outlet housing includes a faceplate with said opening therethrough.

13. In a telecommunications outlet as set forth in claim 12, wherein said guide means project generally perpendicularly away from the rear of the faceplate.

14. In a telecommunications outlet as set forth in claim 13, wherein said guide means comprise opposing track means for engaging opposite side edges of the generally planar support.

15. In a telecommunications outlet as set forth in claim 11, wherein said telecommunications module assembly includes an electrical connector mounted on the generally planar support rearwardly of the telecommunications module for easy access thereto.

16. In a telecommunications outlet which includes an outlet housing and a telecommunications module assembly, the outlet housing including an opening into which a complementary mating telecommunications plug can be inserted from the front of the housing, and the telecommunications module assembly including a telecommunications module mounted on a printed circuit board, wherein the improvement comprises complementary interengaging guide means on the rear of the housing and the printed circuit board for guiding the module assembly into an operable position with the telecommunications module aligned with the opening for mating with the telecommunications plug therethrough and with the printed circuit board projecting generally perpendicularly away from the rear of the outlet housing, and an electrical connector mounted on the printed circuit board rearwardly of the telecommunications module for easy access thereto.

* * * * *